US010661132B1

(12) United States Patent
Wallin

(10) Patent No.: US 10,661,132 B1
(45) Date of Patent: May 26, 2020

(54) GOLF PUTTER HEAD

(71) Applicant: Dub Worx LLC, Eagle Mountain, UT (US)

(72) Inventor: Gavin Wallin, Eagle Mountain, UT (US)

(73) Assignee: Dub Worx LLC, Eagle Mountain, UT (US)

( * ) Notice: Subject to any disclaimer, the term of this patent is extended or adjusted under 35 U.S.C. 154(b) by 0 days.

(21) Appl. No.: 16/240,621

(22) Filed: Jan. 4, 2019

(51) Int. Cl.
*A63B 53/04* (2015.01)
*A63B 53/02* (2015.01)

(52) U.S. Cl.
CPC ..... *A63B 53/0487* (2013.01); *A63B 53/02* (2013.01); *A63B 2053/0433* (2013.01); *A63B 2053/0441* (2013.01)

(58) Field of Classification Search
CPC .... A63B 2053/0441; A63B 2053/0433; A63B 53/02; A63B 53/0487
See application file for complete search history.

(56) References Cited

U.S. PATENT DOCUMENTS 3,134,596 A * 5/1964 Boznos ..... A63B 53/0487 473/250
3,387,844 A * 6/1968 Shippce ..... A63B 53/0466 473/329
D212,890 S * 12/1968 Rose ..... D21/739
D228,563 S * 10/1973 Brower ..... D21/744
4,156,526 A * 5/1979 Huggins ..... A63B 53/0487 473/329
4,199,144 A * 4/1980 Skelly ..... A63B 53/007 473/251
4,444,395 A * 4/1984 Reiss ..... A63B 53/007 473/335
D306,334 S * 2/1990 Alcala ..... D21/739
5,344,149 A * 9/1994 Miller ..... A63B 53/0487 473/340
5,458,332 A * 10/1995 Fisher ..... A63B 53/04 473/251
5,674,132 A * 10/1997 Fisher ..... A63B 53/04 473/290

(Continued)

OTHER PUBLICATIONS

"Special Edition Odyssey Exo 2-Ball Putter", Accessed at <<http://www.odysseygolf.com/families/exo-2-ball/putters-2018-exo-2-ball.html>>, Accessed on Dec. 12, 2018, 6 Pages.

(Continued)

*Primary Examiner* — Stephen L Blau
(74) *Attorney, Agent, or Firm* — Goff IP Law PLLC; Jared Goff

(57) ABSTRACT

A golf putter can include a shaft and a golf putter head attached to the shaft. The head can include a heel, a toe, a top line facing upwardly and extending between the heel and the toe, a sole facing downwardly and extending between the heel and the toe, and a face extending between the top line and the sole, and between the heel and the toe. The head can further include a visual sighting area on the putter head that visually contrasts with a surface region of the putter head that is adjacent to the visual sighting area and on opposing sides of the visual sighting area, with the visual sighting area continuously wrapping from a portion of the visual sighting area on the top line to a portion of the visual sighting area on the face and/or with side edges of the portions being aligned.

11 Claims, 6 Drawing Sheets

(56) References Cited

U.S. PATENT DOCUMENTS

D388,851 S * 1/1998 Rollinson ..... D21/746
5,816,930 A * 10/1998 Brown ..... A63B 69/3685 473/254
5,876,293 A * 3/1999 Musty ..... A63B 53/0487 473/341
5,938,543 A * 8/1999 McGeeney ..... A63B 53/04 473/324
6,001,030 A * 12/1999 Delaney ..... A63B 53/0487 473/329
6,086,484 A * 7/2000 Uebelhor ..... A63B 53/0487 473/251
6,176,791 B1 * 1/2001 Wright ..... A63B 53/0487 473/252
6,270,422 B1 * 8/2001 Fisher ..... A63B 53/0487 473/223
6,569,032 B1 * 5/2003 Haliyo ..... A63B 53/0487 473/313
6,860,822 B2 * 3/2005 Vrska, Jr. ..... A63B 53/0487 473/324
7,037,211 B1 * 5/2006 Kosovac ..... A63B 53/007 473/304
7,108,613 B1 * 9/2006 Gordon ..... A63B 53/0487 473/341
7,134,970 B2 * 11/2006 Lindsay ..... A63B 53/02 473/313
7,666,108 B2 * 2/2010 Bryant ..... A63B 53/04 473/288
7,794,334 B2 * 9/2010 Hilton ..... A63B 53/0487 473/341
D655,361 S * 3/2012 Ramsauer ..... D21/743
D701,274 S * 3/2014 Rollinson ..... D21/736
10,046,211 B2 * 8/2018 Franklin ..... A63B 53/0487
D831,766 S * 10/2018 Schweigert ..... D21/743
2005/0020380 A1 * 1/2005 Yamaguchi ..... A63B 53/0487 473/340

OTHER PUBLICATIONS

Knudson, et al., "The Impact of Vision and Vision Training on Sport Performance", Accessed at <<http://dijq.sportsci.org/news/ferret/visionreview/visionreview.html>>, Accessed on Nov. 26, 2018, 10 Pages.

Pelli, et al., "Measuring Contrast Sensitivity", Vision Research, 2013, pp. 10-14.

Roy, et al., "Visual Assessment of Sports Professionals", International Journal of Current Advanced Research, Oct. 2016, pp. 1295-1300.

* cited by examiner

GOLF PUTTER HEAD

BACKGROUND

Golf putters are common in the game of golf. Golf putters are golf clubs that are designed for striking a golf ball towards a hole when the golf ball is at a relatively short distance from the hole, and typically on a golf green. Specifically, the face of the putter head is designed to strike the ball. Many different golf putters have been designed with different features. Such features have included different sighting aids and different shapes and weighting configurations.

SUMMARY

Whatever the advantages of previous golf putters and golf putter heads, they have neither recognized the putter head features described and claimed herein, nor the advantages produced by such features.

According to one embodiment, a golf putter head can include a heel, a toe, a top line facing upwardly and extending between the heel and the toe; a sole facing downwardly and extending between the heel and the toe; and a face extending between the top line and the sole and between the heel and the toe. The head can further include a visual sighting area on the putter head that visually contrasts with a surface region of the putter head that is adjacent to the visual sighting area and on opposing sides of the visual sighting area, with the visual sighting area including a portion on the top line and a portion on the face, with the portion on the top line extending between a first side edge proximal the heel and a second side edge proximal the toe, with the portion on the face extending between a first side edge proximal the heel and a second side edge proximal the toe, and with the first side edge and the second side of the portion on the top line aligning respectively with the first side edge and the second side edge of the portion on the face.

According to another embodiment, a golf putter includes a shaft and a golf putter head attached to the shaft. The head can include a heel, a toe, a top line facing upwardly and extending between the heel and the toe, a sole facing downwardly and extending between the heel and the toe, and a face extending between the top line and the sole and between the heel and the toe. The head can further include a visual sighting area on the putter head that visually contrasts with a surface region of the putter head that is adjacent to the visual sighting area and on opposing sides of the visual sighting area, with the visual sighting area continuously wrapping from a portion of the visual sighting area on the top line to a portion of the visual sighting area on the face.

According to yet another embodiment, a golf putter head can include a heel, a toe, a top line facing upwardly and extending between the heel and the toe, a sole facing downwardly and extending between the heel and the toe, and a face extending between the top line and the sole and between the heel and the toe. The head can further include a visual sighting area on the putter head that visually contrasts with a surface region of the putter head that is adjacent to the visual sighting area and on opposing sides of the visual sighting area, with the visual sighting area including a portion on the top line that continuously wraps to a portion on the face, with the portion on the top line extending between a first side edge proximal the heel and a second side edge proximal the toe, with the portion on the face extending between a first side edge proximal the heel and a second side edge proximal the toe, and with the first and second side edges of the portion on the top line aligning respectively with the first and second side edges of the portion on the face.

Other features may be used without at least some of the features discussed herein. For example, a golf putter head can include a pair of weights located rearward of the top line, with the weights rising upward from the sole, and with the golf putter head defining a pair of gaps, with one of the gaps extending downwardly into the golf putter head between each of the weights and the top line. This arrangement may produce desirable benefits even without the visual sighting area as discussed in embodiments above.

This Summary is provided to introduce a selection of concepts in a simplified form. The concepts are further described below in the Detailed Description. This Summary is not intended to identify key features or essential features of the claimed subject matter, nor is it intended to be used to limit the scope of the claimed subject matter. Similarly, the invention is not limited to implementations that address the particular techniques, tools, environments, disadvantages, or advantages discussed in the Background, the Detailed Description, or the attached drawings.

BRIEF DESCRIPTION OF THE DRAWINGS

The description and drawings may refer to the same or similar features in different drawings with the same reference numbers.

DETAILED DESCRIPTION

Figure 1:
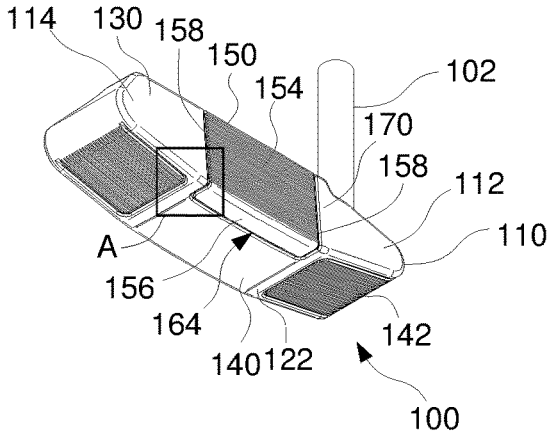
FIG. 1 is a front-bottom-toe perspective view of a blade putter.

Referring to FIGS. 1-10, a golf putter (100) will be discussed. The putter (100) can include a shaft (102) (with only the bottom of the shaft being illustrated) that can be attached to a putter head (110) near a heel (112) of the putter head. The putter head (110) can further include a toe (114) distal from the heel (112). An upwardly-facing top line (120) can extend between the heel (112) and the toe (114). Similarly, a downwardly-facing sole (122) can also extend between the heel (112) and the toe (114). A forward-facing putter face (130) can extend generally horizontally between a front edge of the top line (120) and a front edge of the sole (122), with the face (130) also extending vertically between the heel (112) and the toe (114). During normal use of the golf club (100), the face is designed to strike the golf ball. The face (130) may be at some angle relative to vertical during normal use, with the angle being known as the putter loft.

The putter head (110) can further include a rear bottom flange (132) that extends rearward from the bottom of the putter head (110) behind the top line (120), with the bottom of the flange (132) forming part of the sole (122), and with the flange (132) not extending upwardly as far as the top line (120). Thus, the top surface of the putter head (110) can include the top line (120) and then drop down to include the top of the flange (132). The sole (122) can include a generally flat central portion (140) and side portions (142), with the side portions angling upwardly from the central portion (140) toward the toe (114) and the heel (112). The upwardly-angle side portions (142) of the sole can define alternating downwardly-extending ridges (144) and upwardly-extending channels (146) (see FIG. 1A), with the ridges (144) and channels (146) extending between the central portion (140) and the toe (114), and between the central portion (140) and the heel (112).

Referring still to FIGS. 1-10, the putter head (110) can include a visual sighting area (150), which can be centrally located between the heel (112) and the toe (114). For example, a sweet spot for the putter can be generally centrally aligned with the visual sighting area (150) (e.g., with the distance from the heel or toe along the face (130) to the sweet spot being the same as the distance to the center of the visual sighting area (150)). As an example, the sweet spot can be aligned with the putter head's center of gravity (or center of mass) in the direction of travel of the putter (100) during use (typically aligned with the center of gravity in a direction that is generally perpendicular to the face (130)). Also, the wall of the putter may be thinner in an area around the sweet spot, as is illustrated with cavity (151) extending into the rear of the putter head (110) behind the face (130).

The sighting area (150) can include a generally rectangular top portion (152) that faces up and extends along a central portion of the top line (120) adjacent to the face (130), a generally rectangular face portion (154) that faces forward and extends along a central portion of the face (130), and a generally rectangular bottom portion (156) that faces down and extends along a central portion of the sole (122) adjacent to the face (130). The top portion (152) can be an elongate area that is longer along a first direction extending between the heel (112) and the toe (114) than along a second direction along the top line that is perpendicular to that first direction. The visual sighting area (150) can continuously wrap between the different portions of the visual sighting area (150), with the different portions being joined to each other. The visual sighting area (150) may be considered to continuously wrap from one portion to another if those portions are joined so that they appear to be continuous, which can be the case even if there is a narrow feature between them, such as a narrow line that is painted a different color from the visual sighting area (150). However, in some embodiments, there may be no features between the different portions of the visual sighting area (150) that would visually contrast with the visual sighting area (150). Also, different portions of the visual sighting area (150) may be different colors so long as they visually contrast with surface regions around them.

The top portion (152) may be seen while a golfer is putting, to aid in aligning the putter head (110) with the golf ball. The inclusion of the face portion (154) can further assist the golfer in solidifying the mental connection between the visual top portion (152) that can be seen during putting, and the position of the sweet spot of the putter head (110), which can coincide with a central portion of the face portion (154) of the visual sighting area (150). The bottom portion (156) may further solidify this mental connection, providing the golfer with added confidence and visual direction during putting, which can result in a better putting motion.

Side edges (158) of the sighting area (150) can be spaced apart about the same distance as the diameter of a standard golf ball, which is typically about 1.68 inches—the distance between a first side edge (158) proximal the heel (112) to a second side edge (158) proximal the toe (114). Thus, each of the top portion (152), face portion (154), and bottom portion (156) can be about 1.68 inches wide in a direction extending between the heel (112) and toe (114) of the putter head (110). For example, the width of each portion of the sighting area (150) can be within twenty percent of 1.68 inches (between 1.344 inches and 2.016 inches), within ten percent of 1.68 inches, within five percent of 1.68 inches, or within one percent of 1.68 inches. Such ranges can be helpful so that the sides (158) of the sighting area (150) appear to align with the sides of a golf ball being struck with the putter head (110).

Figure 1A:
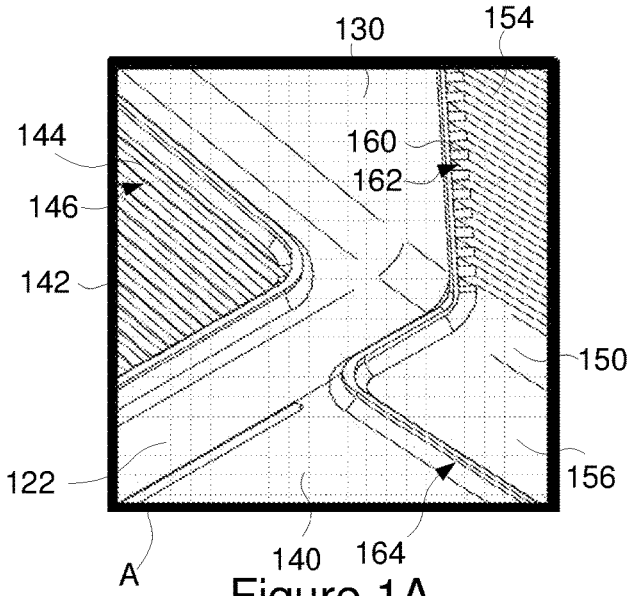
FIG. 1A is an enlarged view of an area A in FIG. 1, enlarged to illustrate features of ridges and grooves on the front face and sole. Grooves and ridges of the front faces and soles of other embodiments can be like those illustrated in FIG. 1A.
Figure 2:
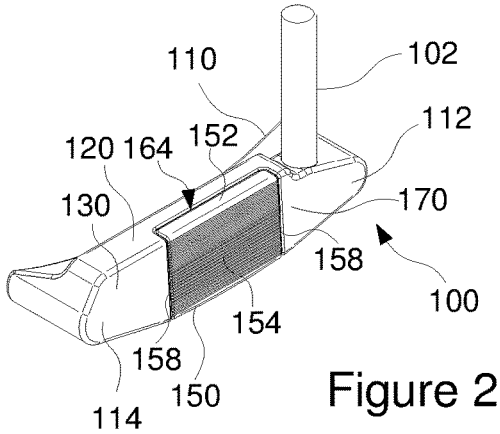
FIG. 2 is a front-top-toe perspective view of the putter of FIG. 1.
Figure 3:
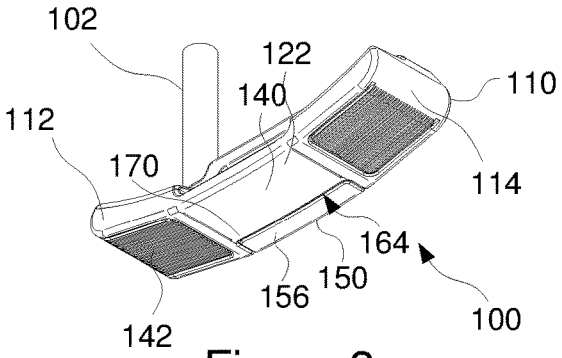
FIG. 3 is a rear-bottom-toe perspective view of the putter of FIG. 1.
Figure 4:
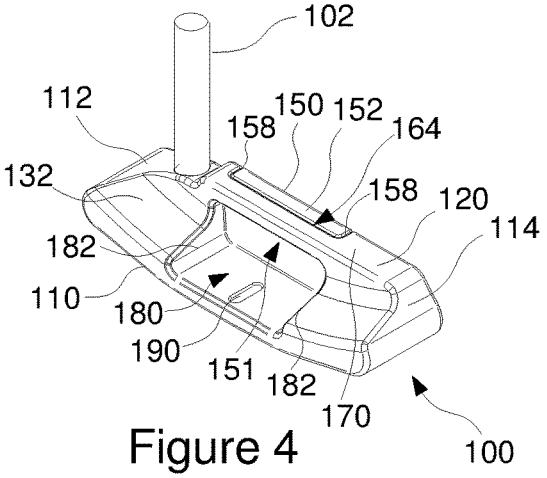
FIG. 4 is a rear-top-toe perspective view of the putter of FIG. 1.
Figure 5:
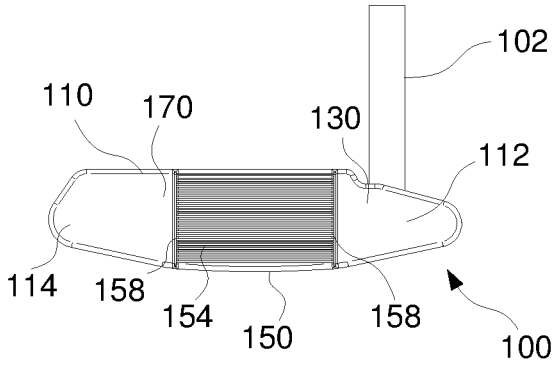
FIG. 5 is a front view of the putter of FIG. 1.
Figure 6:
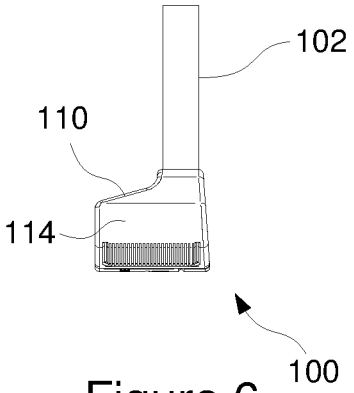
FIG. 6 is a toe-side view of the putter of FIG. 1.
Figure 7:
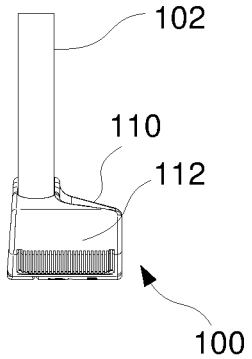
FIG. 7 is a heel-side view of the putter of FIG. 1.
Figure 8:
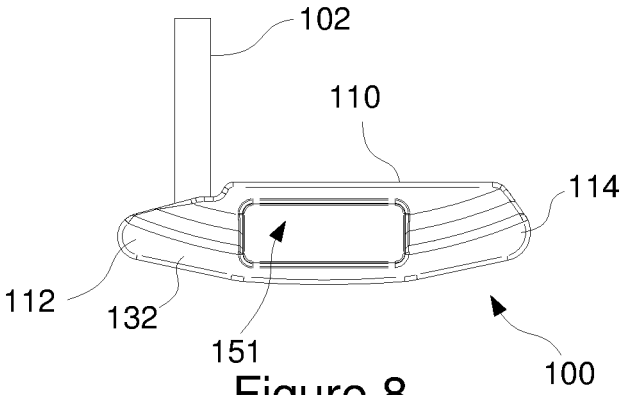
FIG. 8 is a rear view of the putter of FIG. 1.
Figure 9:
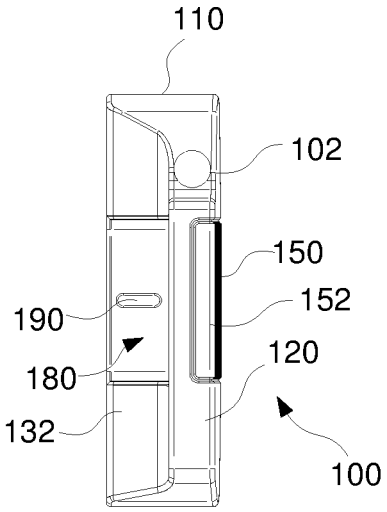
FIG. 9 is a top view of the putter of FIG. 1.
Figure 10:
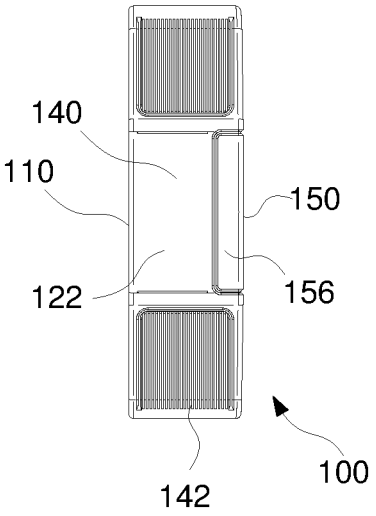
FIG. 10 is a bottom view of the putter of FIG. 1.
Figure 11:
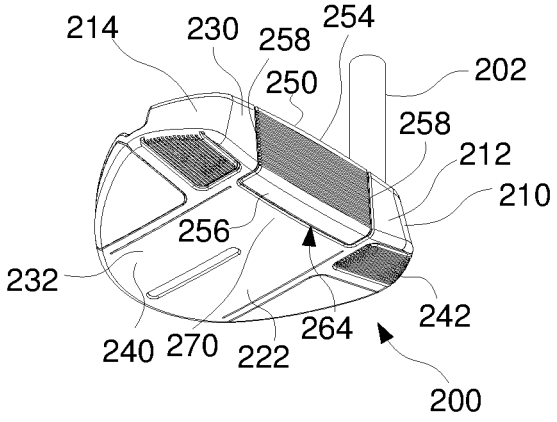
FIG. 11 is a front-bottom-toe perspective view of a mid-mallet putter.
Figure 12:
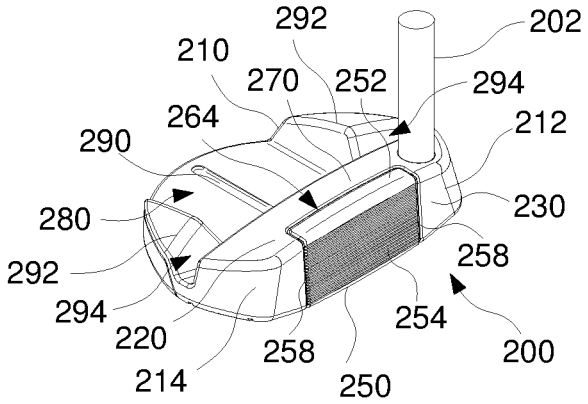
FIG. 12 is a front-top-toe perspective view of the putter of FIG. 11.
Figure 13:
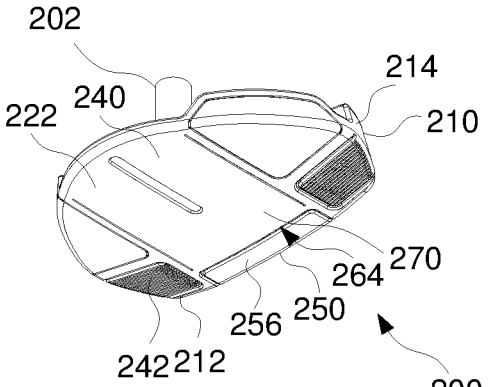
FIG. 13 is a rear-bottom-toe perspective view of the putter of FIG. 11.
Figure 14:
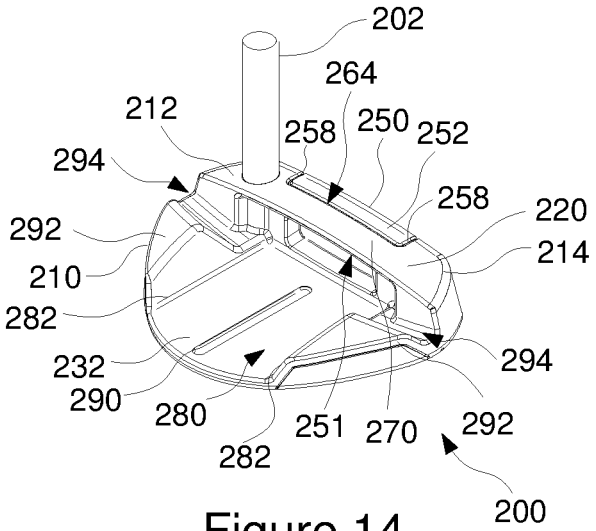
FIG. 14 is a rear-top-toe perspective view of the putter of FIG. 11.
Figure 15:
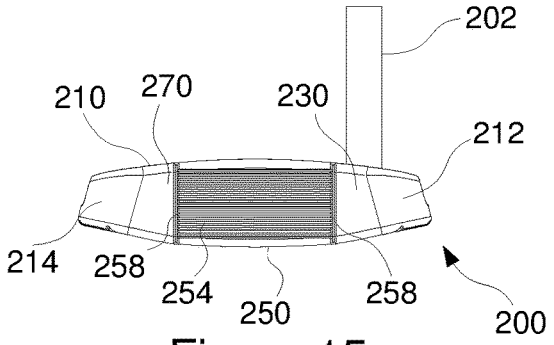
FIG. 15 is a front view of the putter of FIG. 11.
Figure 16:
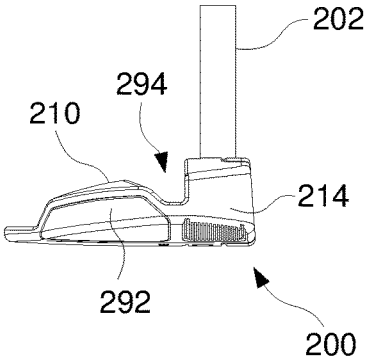
FIG. 16 is a toe-side view of the putter of FIG. 11.
Figure 17:
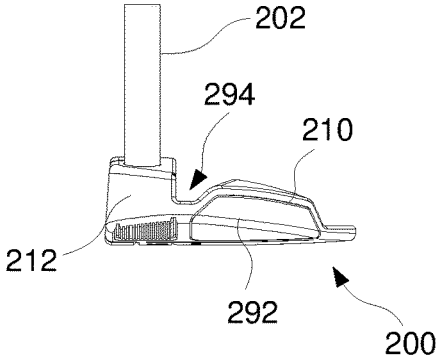
FIG. 17 is a heel-side view of the putter of FIG. 11.
Figure 18:
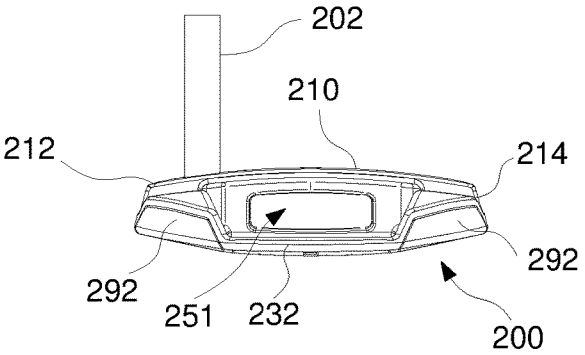
FIG. 18 is a rear view of the putter of FIG. 11.
Figure 19:
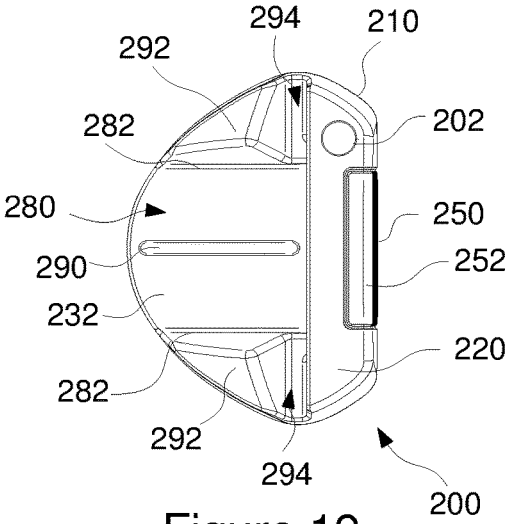
FIG. 19 is a top view of the putter of FIG. 11.
Figure 20:
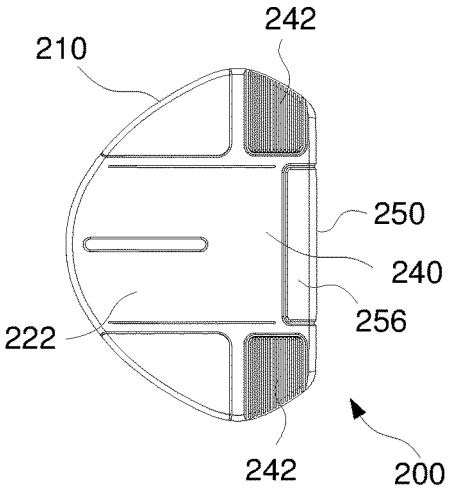
FIG. 20 is a bottom view of the putter of FIG. 11.
Figure 21:
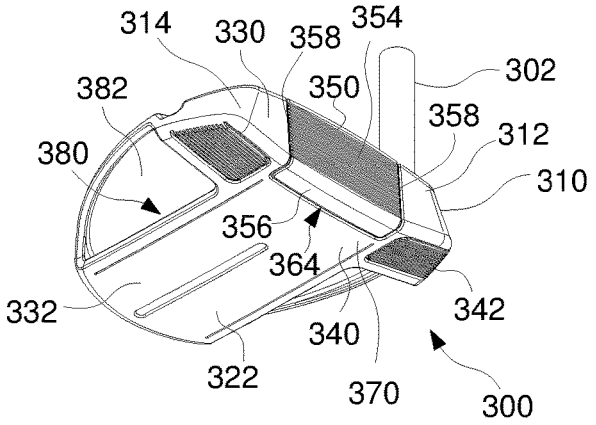
FIG. 21 is a front-bottom-toe perspective view of a mallet putter.
Figure 22:
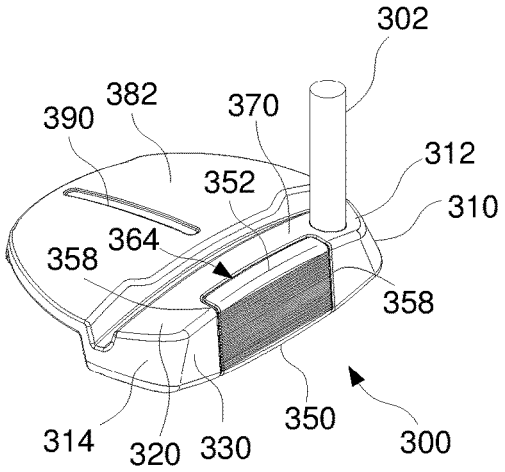
FIG. 22 is a front-top-toe perspective view of the putter of FIG. 21.
Figure 23:
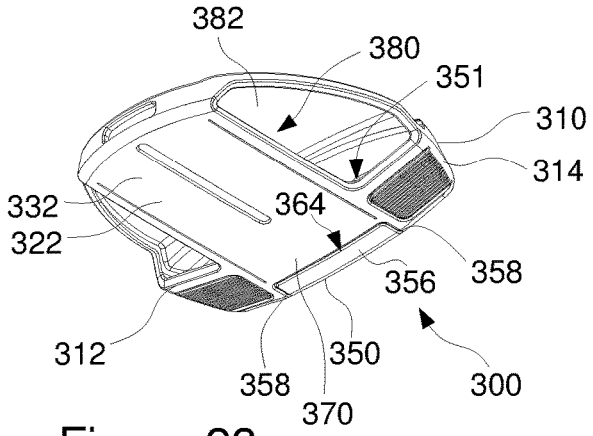
FIG. 23 is a rear-bottom-toe perspective view of the putter of FIG. 21.
Figure 24:
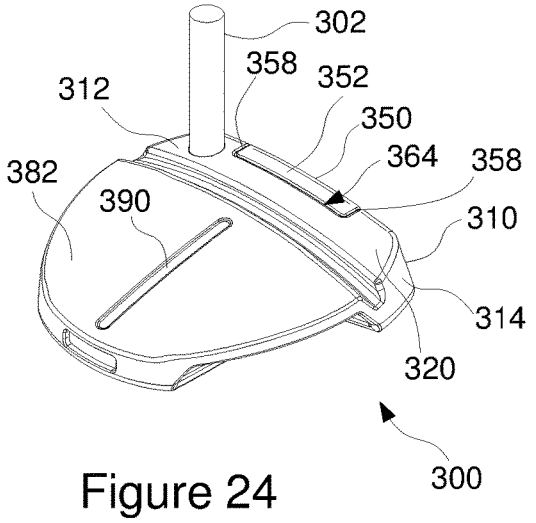
FIG. 24 is a rear-top-toe perspective view of the putter of FIG. 21.
Figure 25:
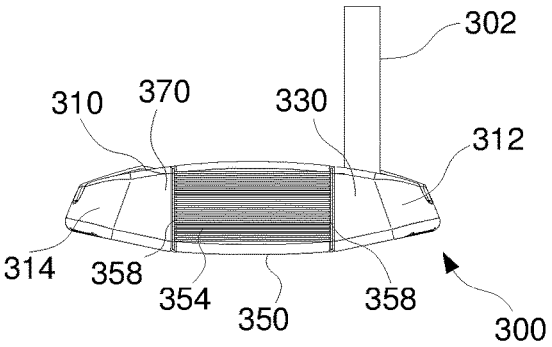
FIG. 25 is a front view of the putter of FIG. 21.
Figure 26:
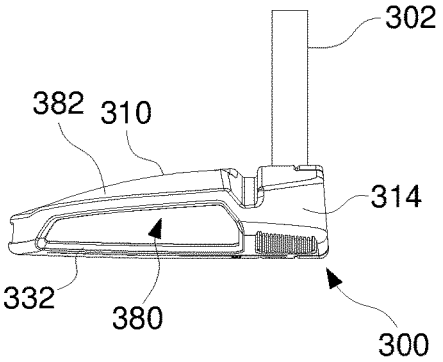
FIG. 26 is a toe-side view of the putter of FIG. 21.
Figure 27:
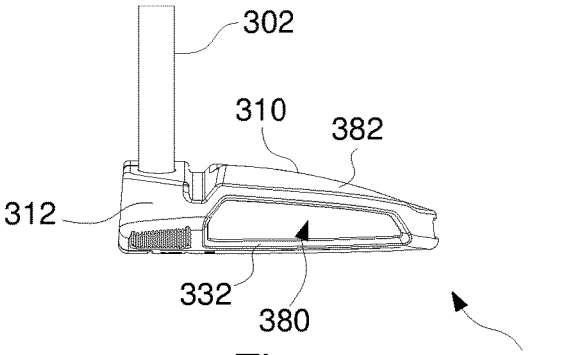
FIG. 27 is a heel-side view of the putter of FIG. 21.
Figure 28:
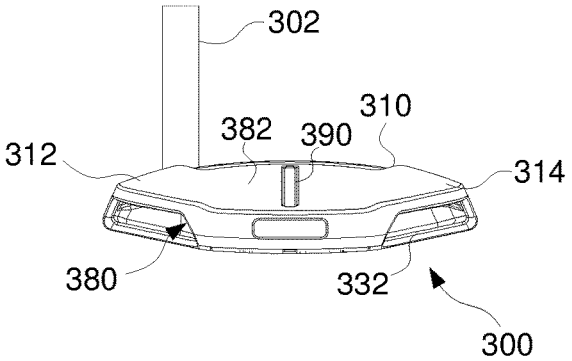
FIG. 28 is a rear view of the putter of FIG. 21.
Figure 29:
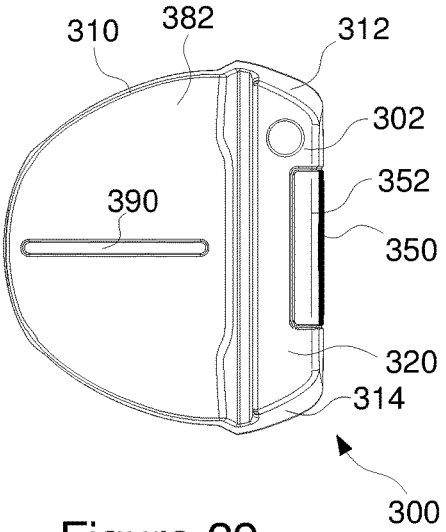
FIG. 29 is a top view of the putter of FIG. 21.
Figure 30:
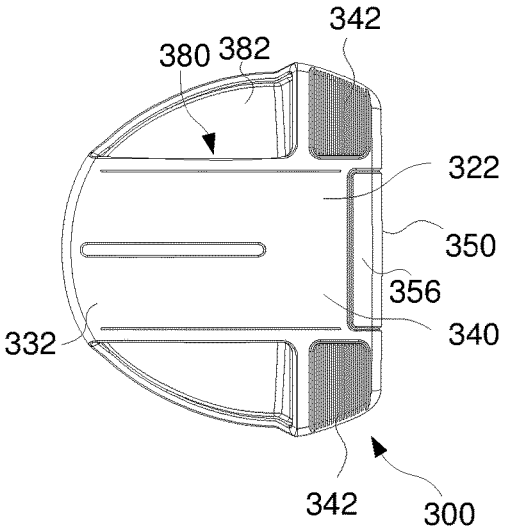
FIG. 30 is a bottom view of the putter of FIG. 21.

The face portion (154) of the sighting area (150) can define horizontally extending alternating ridges (160) and channels (162) (see FIG. 1A). Such ridges (160) can assist in engaging a golf ball when the putter head (110) strikes the ball at the face portion (154), although there are many different patterns of ridges or even different types of surface features that may be used instead of the particular pattern of ridges (160) illustrated in FIG. 1A. The sighting area (150) can be visually contrasted from an adjacent surface region (170) of the putter head that is adjacent to the visual sighting area (150) and on opposing sides (158) of the visual sighting area (150). For example, the adjacent surface region (170) can include all the surface region that surrounds the visual sighting area (150).

The putter head (110) can also define a border groove (164) that can extend into the putter head (110) around at least a portion of the border of the visual sighting area (150) to divide the sighting area (150) from the adjacent surface region (170) (see, e.g., FIG. 1A). In the illustrated embodiment, the border groove (164) can extend around the entire border of the visual sighting area (150). The border groove (164) can help to provide further visual contrast between the visual sighting area (150) and the adjacent surface region (170). The border groove (164) may be the same color as the visual sighting area (150), the same color as the adjacent surface region (170), or part of the border groove (164) may be the same color as the sighting area (150) and another part may be the same color as the adjacent surface region (170) (such as where different colors meet at the bottom of the border groove (164)). As yet another alternative, all or part of the border groove (164) may be a different color, so that the border groove (164) is contrasted from the sighting area (150) and from the adjacent surface region (170).

As an example, the adjacent surface region (170) may be a dark color such as black, while the visual sighting area (150) may be a light color such as silver. As another example, the adjacent surface region (170) may be a light color such as white, and the visual sighting area may be a dark color such as black. Other contrasting colors may also be used. For example, red and blue may be used to contrast from each other, or red and black may be used to contrast from each other. Also, the color contrast may include dark and light colors that are the same type of color, such as a dark red and a contrasting light red, and so forth.

The putter head (110) can also include a cavity (180) that extends down into the rear flange (132), with the cavity extending rearward from the back of the top line (120). The cavity (180) can include opposite sides (182) that extend back from the top line (120), with the sides (182) being aligned with the sides (158) of the sighting area (150) (i.e., sufficiently aligned so that they appear to be aligned when the golf putter (100) is in use). Such alignment can assist in visual alignment of the sighting area (150) with a golf ball being struck.

The putter head (110) can also include a center line (190), which can extend in the direction of travel of the club during use (substantially perpendicular to the face (130)). The center line (190) may be recessed or raised (or even a through hole), and it may visually contrast from a surface region around the center line (190). For example, the center line (190) may be white, while the region surrounding the center line (190) may be black, and the center line (190) may be recessed or a through hole. The center line (190) can be aligned with the center of the sighting area (150), which can be aligned with the center of gravity and the sweet spot of the putter head (110), all along the designed direction of travel of the putter head (110) during use (substantially perpendicular to the face (130).

Referring now to FIGS. 11-20, a mid-mallet putter (200) will be discussed. The putter (200) can be similar to the blade putter (100) in many respects. For example, the putter (200) can include a similar shaft (202), and the putter head (210) can also be similar to the putter head (110). For example, the putter head (210) can include a similar heel (212), toe (214), top line (220), sole (222), face (230), rear bottom flange (232), flat sole central portion (240), and sole side portions (242) with ridges and channels. The putter head (210) can also include a similar visual sighting area (250) and a cavity (251) extending forwardly into the wall behind the visual sighting area (250). The visual sighting area (250) can include a top portion (252), face portion (254), and bottom portion (256). The sides (258) of the top portion (252), face portion (254) and bottom portion (256) can be aligned with each other and be similarly spaced from each other so that the sighting area (250) has a similar width to the sighting area (150) discussed above. The face portion (254) can also include similar ridges and channels to the ridges and channels (162) discussed above. The putter head (210) can also define a border groove (264) between the sighting area (250) and the adjacent surface region (270). Also, the sighting area (250) can similarly be visually contrasted with the adjacent surface region (270), as discussed above. The putter head (210) can also define a cavity (280) that extends rearward from the top line (220). Sides (282) of a floor of the cavity (280) can align with sides (258) of the sighting area (250), as discussed above. Additionally, the putter head (210) can include a center line (290) extending along the floor of the cavity (280), like the center line discussed above for the blade putter head (110).

However, the rear flange (232) of the putter head (210) can extend farther back than with the rear flange (132) of the blade putter head (110). Additionally, material to the sides of the cavity (280) can act as weights (292), which can bring the center of mass of the putter head (210) rearward and can also increase the moment of inertia of the putter head (210). This is similar to the material to the sides of the cavity (180) for the blade putter head (110). However, the mid-mallet putter head (210) can define a pair of gaps (294), with a gap extending downwardly into the putter head (210) between each of the weights (292) and the top line (220).

Referring now to FIGS. 21-30, a mallet putter (300) will be discussed. The putter (300) can be similar to the putter (100) in many respects. For example, the putter (300) can include a similar shaft (302), and the putter head (310) can also be similar to the putter head (110). For example, the putter head (310) can include a heel (312), toe (314), top line (320), sole (322), face (330), rear bottom flange (332), flat sole central portion (340), and sole side portions (342) with ridges and channels. The putter head (310) can also include a similar visual sighting area (350) and a cavity (351) extending forwardly into the wall behind the visual sighting area (350). The visual sighting area (350) that can include a top portion (352), face portion (354), and bottom portion (356). The sides (358) of the top portion (352), face portion (354) and bottom portion (356) can be aligned with each other and be similarly spaced from each other so that the sighting area (350) has a similar width to the sighting area (150) discussed above. The face portion (354) can also include similar ridges and channels to the ridges (160) and channels (162) discussed above. The putter head (310) can also define a border groove (364) between the sighting area (350) and the adjacent surface region (370). Also, the sighting area (350) can similarly be visually contrasted with the adjacent surface region (370), as discussed above.

The putter head (310) can define a cavity (380) between the bottom flange (332) and a top flange (382). The bottom flange (332) can be generally planar with some curvature that is generally convex on the bottom and concave on the top. The bottom flange (332) can include a front portion that extends back from the central portion (340) and the side portions (342) of the sole, and can include a rear portion that continues farther back from the flat central portion (340) of the sole (322) (with the rear portion not extending back from the side portions (142) of the sole). The top flange (382) can be concavely curved on its top side and convexly shaped on its bottom side. The top and bottom flanges can meet at the rear of the putter head (310), distal from the face (330). Additionally, the putter head (310) can include a center line (390) extending along the top of the top flange (382), similarly to the center line discussed above for the blade putter head (110).

In making the putter s discussed above, different manufacturing techniques may be used, depending on considerations such as cost and quality control. As an example, a putter head can be cast metal, such as stainless steel, an aluminum alloy, a titanium alloy, or some other material such as a bronze, brass, copper, or zinc material. Fine features can then be milled into the head. For example, such features may include the alternating ridges and channels, which may be milled by milling out the channels, so that the ridges are left between the channels. Similarly, the border grooves may be milled into the putter head. The visual sighting area may be masked, and the remainder of the putter head can be colored, so that the visual sighting area can remain a silver color of the metal. As an example, the remainder of the putter head may be a black color. As an example, this may be done using a physical vapor deposition (PVD) coating. This may result in the surface of the sighting portion being less hard than the other surfaces of the putter head. After the remainder of the head is colored a base color (such as black), additional features can be added with different coloring, such as with painting techniques. For example, these additional features may include logos, lettering, and/or the center line. The putter head can be secured to the shaft using an adhesive, or in some other manner Other different materials and/or manufacturing techniques may be used in making putters as discussed herein.

In additional to the useful features of the putters discussed above, the putters have been designed with particularly pleasing aesthetic ornamental features. Such ornamental features may include the shapes of the overall putter heads and/or the individual features of the putter heads. For example, the arrangements of the visual sighting areas with the visual contrast (such as color contrast) between the visual sighting areas and the surrounding surface regions provides an aesthetically pleasing ornamental look to the different putter heads. Such aesthetically pleasing designs can include some features of the putter heads but not others. For example, new and pleasing designs can include the shapes of one or more of the portions of a sighting area along with its contrast with the immediately surrounding surface regions, without including the alternating ridges and channels of the sighting area, and possibly without include other features of the club heads. In other embodiments, all the features, or any other subsets of features of the putter heads can be included in ornamental designs of the putter heads.

The subject matter defined in the appended claims is not necessarily limited to the benefits described herein. A particular implementation of the invention may provide all, some, or none of the benefits described herein. Also, while the invention has been particularly shown and described with reference to preferred embodiments thereof, it will be understood by those skilled in the art that various changes in form and details may be made therein without departing from the spirit and scope of the invention. For example, the visual sighting area may be manufactured as a separate portion (e.g., a face plate portion) that is attached to the head, rather than being integrally formed with the head as discussed above.

I claim:

1. A golf putter head comprising:

a heel;

a toe a top line facing upwardly and extending between the heel and the toe;

a sole facing downwardly and extending between the heel and the toe;

a face extending between the top line and the sole and between the heel and the toe;

a visual sighting area on the golf putter head that visually contrasts with a surface region of the golf putter head that is adjacent to the visual sighting area and on opposing sides of the visual sighting area, with the visual sighting area including a portion on the top line that continuously wraps to a portion on the face, with the portion on the top line extending between a first side edge proximal the heel and a second side edge proximal the toe, with the portion on the face extending between a first side edge proximal the heel and a second side edge proximal the toe, and with the first and second side edges of the portion on the top line aligning respectively with the first and second side edges of the portion on the face, wherein a downwardly-extending cavity extends back and away from the top line, with sides of the cavity extending back and away from the top line, and with the sides of the cavity being aligned with sides of the visual sighting area; and a pair of weights located rearward of the top line and on opposite sides of the cavity, with the weights rising upward from the sole, and with the golf putter head defining a pair of gaps, with one of the gaps extending downwardly into the golf putter head between each of the weights and the top line.

2. The golf putter head of claim 1, wherein the portion of the visual sighting area on the top line is an elongate area that is longer along a first direction extending between the heel and the toe than along a second direction along the top line that is perpendicular to the first direction.

3. The golf putter head of claim 1, wherein a distance across the visual sighting area in a direction extending between the toe and the heel of the golf putter head is within twenty percent of 1.68 inches.

4. The golf putter head of claim 3, wherein the distance across the visual sighting area in the direction extending between the toe and the heel of the golf putter head is within ten percent of 1.68 inches.

5. The golf putter head of claim 3, wherein the distance across the visual sighting area in the direction extending between the toe and the heel of the golf putter head is within five percent of 1.68 inches.

6. The golf putter head of claim 3, wherein the distance across the visual sighting area in the direction extending between the toe and the heel of the golf putter head is within one percent of 1.68 inches.

7. The golf putter head of claim 1, wherein the portion of the visual sighting area on the top line is substantially rectangular.

8. The golf putter head of claim 7, wherein the portion of the visual sighting area on the face is substantially rectangular.

9. The golf putter head of claim 1, wherein the visual sighting area further comprises a portion on the sole, with side edges of the portion on the sole aligning with the side edges of the portion on the face.

10. The golf putter head of claim 1, wherein the visual contrasting between the visual sighting area on the golf putter head and the surface region of the golf putter head adjacent to the visual sighting area comprises a color contrast, with one or more colors of the visual sighting area contrasting with one or more colors of the surface region area of the golf putter head adjacent to the visual sighting area.

11. The golf putter head of claim 10, wherein one of the visual sighting area and the surface region of the golf putter head adjacent to the visual sighting area is a lighter color than the other of the visual sighting area and the surface region of the golf putter head adjacent to the visual sighting area.

* * * * *